US008932034B2

(12) United States Patent
McKinney et al.

(10) Patent No.: US 8,932,034 B2
(45) Date of Patent: Jan. 13, 2015

(54) WELL PUMP WITH SEAL SECTION HAVING A LABYRINTH FLOW PATH IN A METAL BELLOWS

(75) Inventors: Kelsey A. McKinney, Claremore, OK (US); Dan A. Merrill, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 383 days.

(21) Appl. No.: 13/536,648

(22) Filed: Jun. 28, 2012

(65) Prior Publication Data

US 2013/0004344 A1 Jan. 3, 2013

Related U.S. Application Data

(60) Provisional application No. 61/502,660, filed on Jun. 29, 2011.

(51) Int. Cl.

| | |
|---|---|
| ***F04B 35/04*** | (2006.01) |
| ***E21B 4/04*** | (2006.01) |
| ***E21B 33/00*** | (2006.01) |
| ***E21B 43/00*** | (2006.01) |
| ***E21B 43/12*** | (2006.01) |
| ***F04D 13/10*** | (2006.01) |
| ***F04D 29/10*** | (2006.01) |
| *F04C 13/00* | (2006.01) |
| *F04C 15/00* | (2006.01) |

(52) U.S. Cl.

CPC ..... *E21B 43/128* (2013.01); *F04D 13/10* (2013.01); *F04D 29/106* (2013.01); *F04C 13/008* (2013.01); *F04C 15/0038* (2013.01)

USPC ..... 417/414; 166/66.4; 166/68; 166/105; 417/424.2

(58) Field of Classification Search

CPC ..... F04D 13/10; E21B 43/128

USPC ..... 417/53, 360, 372, 423.3, 423.7, 423.11, 417/423.14, 423.15, 424.1, 424.2, 472; 166/66.4, 68, 105; 310/87

See application file for complete search history.

(56) References Cited

U.S. PATENT DOCUMENTS

| | | | | |
|---|---|---|---|---|
| 3,502,919 | A * | 3/1970 | Drake et al. | 310/87 |
| 4,940,911 | A | 7/1990 | Wilson | |
| 5,622,222 | A | 4/1997 | Wilson et al. | |
| 6,851,935 | B2 * | 2/2005 | Merrill et al. | 417/53 |
| 7,066,248 | B2 * | 6/2006 | Howell | 166/105.5 |

(Continued)

OTHER PUBLICATIONS

U.S. Appl. No. 12/730,950, filed Mar. 24, 2010.

(Continued)

*Primary Examiner* — Devon Kramer
*Assistant Examiner* — Christopher Brunjes
(74) *Attorney, Agent, or Firm* — Bracewell & Giuliani LLP

(57) ABSTRACT

A submersible well pump assembly has a rotary pump, a motor, and a seal section coupled between the motor and the pump. The seal section has a cylindrical housing having upper and lower adapter and a shaft extending axially through the housing. A guide tube surrounds the shaft and a bellows surrounds the guide tube. A well fluid passage communicates well fluid to a well fluid chamber between the bellows and the housing. A guide tube passage extends axially within the guide tube between an interior and an exterior of the guide tube from an upper portion to a lower portion of the guide tube for communicating lubricant in the motor with lubricant within the bellows.

20 Claims, 3 Drawing Sheets

(56) References Cited

U.S. PATENT DOCUMENTS

| | | | | |
|---|---|---|---|---|
| 7,530,391 | B2 | 5/2009 | Hall et al. | |
| 7,665,975 | B2 * | 2/2010 | Parmeter et al. | 417/423.11 |
| 7,708,534 | B2 | 5/2010 | Parmeter et al. | |
| 2007/0074872 | A1 | 4/2007 | Du et al. | |
| 2007/0140876 | A1 | 6/2007 | Parmeter et al. | |
| 2011/0236233 | A1 * | 9/2011 | Merill | 417/410.1 |

OTHER PUBLICATIONS

U.S. Appl. No. 12/262,447, filed Oct. 31, 2008.

* cited by examiner

WELL PUMP WITH SEAL SECTION HAVING A LABYRINTH FLOW PATH IN A METAL BELLOWS

CROSS-REFERENCE TO RELATED APPLICATION

This application claims priority to provisional application Ser. No. 61/502,660 filed Jun. 29, 2011.

FIELD OF THE INVENTION

This disclosure relates in general to oil well submersible pumps and in particular to a seal section located between a centrifugal pump and an electric motor, the seal section having a metal bellows.

BACKGROUND OF THE INVENTION

Submersible well pump assemblies may be employed in oil and gas wells lacking sufficient pressure to lift liquid well fluids. One type employs a rotary pump driven by a down hole motor. The motor is normally electrical, and the pump may be centrifugal. The motor is filled with a dielectric lubricant to lubricate the bearings and assist in cooling the motor.

A seal section or motor protector is coupled between the pump and the motor. The seal section has a flexible member for reducing a difference between hydrostatic pressure in the well and the lubricant pressure in the motor. The flexible member may be an elastomeric bag or it may be a metal bellows. The seal section has a well fluid port that communicates well fluid with one side of the flexible member, normally the outer side. The seal section has a lubricant port that communicates lubricant in the motor with a lubricant chamber, normally the inside of the flexible member. A guide tube may be located within the flexible member surrounding the shaft.

Upper and lower seals seal to the shaft within the seal section. Typically, some well fluid will leak past these seals and eventually enter the lubricant chamber of the flexible member. If the well fluid is able to migrate from the lubricant chamber down into the motor, the life, of the motor will likely be shortened. Encroaching well fluid may particularly be a problem in wells that are inclined. In the past various structures have been provided to cause any well fluid that might enter the lubricant chamber to flow upward, then back downward in a labyrinth or serpentine arrangement. The lubricant is normally lighter than the well fluid, thus the labyrinth makes the journey for encroaching well fluid into the motor more difficult.

While successful, space to provide these labyrinth structures may be inadequate. For example, a metal bellows may have one portion of smaller diameter than other portion. The smaller diameter portion extends into the larger diameter portion. The inner diameter of the smaller diameter portion is often very close or even touching the guide tube. There may not be enough room to include labyrinth pipes in the bellows.

SUMMARY

The submersible well pump assembly of this disclosure has a rotary pump, a motor for driving the pump, and a seal section coupled between the motor and the pump. The seal section has a cylindrical housing having a longitudinal axis, an upper adapter and a lower adapter. A shaft extends axially through the housing, the upper adapter and the lower adapter for transmitting rotation from the motor to the pump. A guide tube surrounds the shaft and extends between the upper and lower adapters. A flexible member surrounds the guide tube, having an upper end sealed to the upper adapter and a lower end sealed to the lower adapter, defining a lubricant chamber between the guide tube and the flexible member and a well fluid chamber between the flexible member and the housing. The housing has a well fluid passage for communicating well fluid to the well fluid chamber to apply a hydrostatic force to the flexible member corresponding to a hydrostatic force of the well fluid. At least one guide tube passage extends axially within the guide tube between an interior and an exterior of the guide tube from an upper portion to a lower portion of the guide tube. An upper portion of the guide tube passage is in fluid communication with lubricant in the lubricant chamber. A lower lubricant communication passage in the lower adapter is in fluid communication with a lower portion of the guide tube passage for communicating lubricant in the motor with the lubricant chamber via the guide tube passage.

Preferably, the lower lubricant communication passage is sealed from an inner annular space between the guide tube and the shaft. Also, the upper portion of the guide tube passage is sealed from the inner annular space between the shaft and the guide tube. The guide tube passage may be a cylindrical bore extending parallel with an axis of the guide tube and having a diameter less than a radial thickness of the guide tube from the interior to the exterior of the guide tube.

The flexible member may be a bellows with a larger diameter portion and a smaller diameter portion, the smaller diameter portion extending into the larger diameter portion and having an inner side in substantial contact with the exterior of the guide tube. In the embodiment shown, the smaller diameter portion defines an upper end of the bellows.

An upper seal is mounted between the upper adapter and the shaft. A top cap may be secured to a lower side of the upper adapter below the seal. An upper end of the guide tube is secured sealingly to the top cap, isolating the exterior of the guide tube from an inner annular space between the guide tube and the shaft.

A lower seal is mounted between the lower adapter and the shaft. A bottom cap may be secured sealingly to the lower adapter above the lower seal. The lower end of the guide tube is secured sealingly to the bottom cap. The lower lubricant communication passage extends through the bottom cap and into fluid communication with a lower end of the axial passage at a point that is sealed from an inner annular space between the guide tube and the shaft and above the lower seal.

An upper leakage chamber may be located below the upper seal and above the guide tube for receiving any leakage of well fluid past the upper seal. A lower leakage chamber may be above the lower seal and below the guide tube for receiving any leakage of well fluid past the lower seal. The inner annular space between the shaft and the guide tube between the upper and lower leakage chambers may be in fluid communication with the upper and lower leakage chambers. The guide tube passage is sealed from the inner annular space. There may be two or more guide tube passages, each of the guide tube passages being a cylindrical bore spaced circumferentially apart from and parallel to the other.

DETAILED DESCRIPTION

Figure 1:
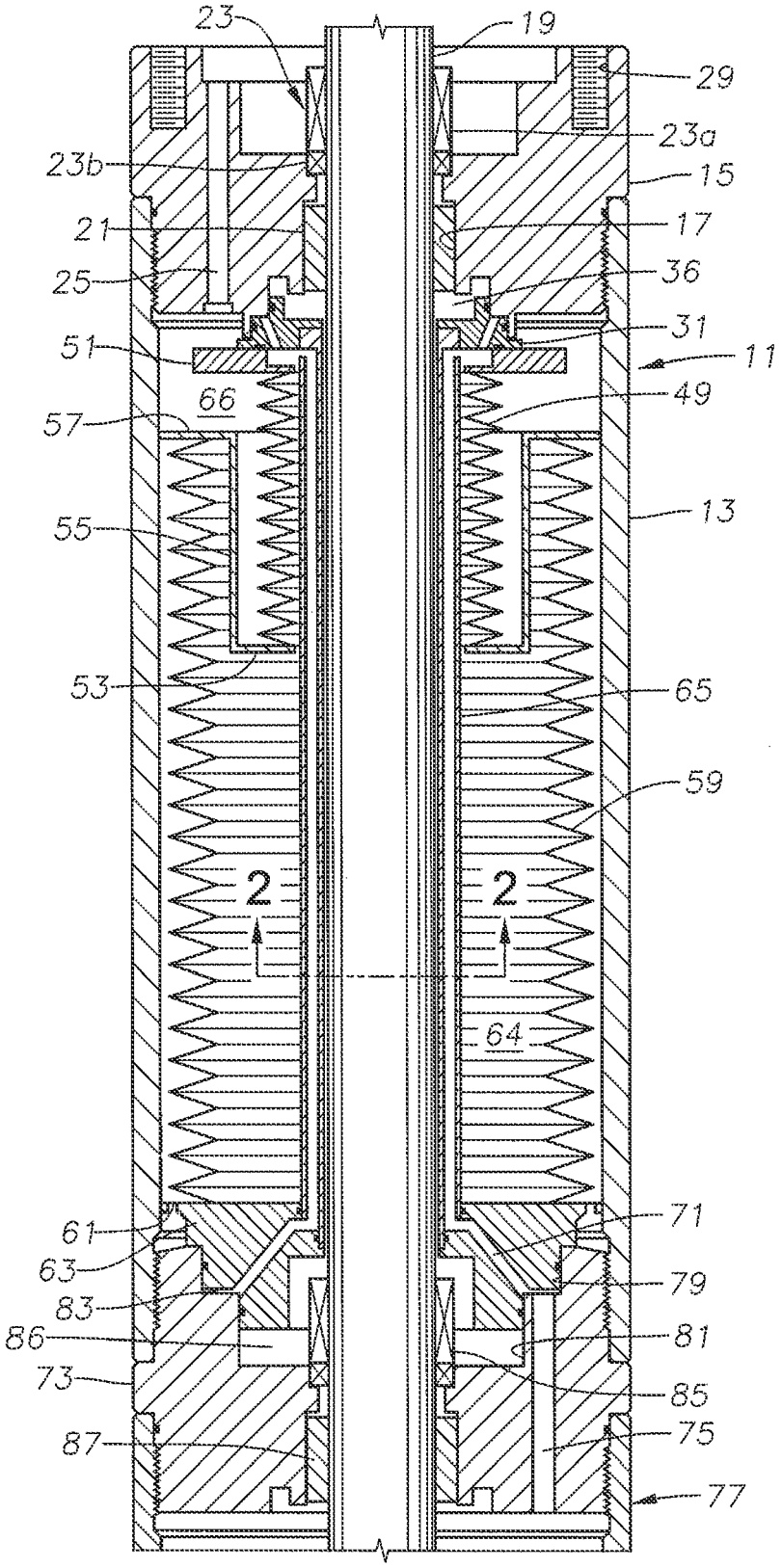
FIG. 1 is a sectional view of a seal section constructed in accordance with this disclosure.

Referring to FIG. 1, an upper seal section 11, which may also be called a motor protector, has a cylindrical housing 13. An upper adapter 15 secures to threads formed on the inner diameter of housing 13. Upper adapter 15 has a central bore 17 through which a rotatable drive shaft 19 extends. A bushing 21 in bore 17 radially supports shaft 19 but does not form seal around shaft 19. An upper seal 23 is mounted in adapter bore 17 above bushing 21 for sealing around shaft 19. Upper seal 23 is typically a mechanical face seal having a rotating component 23*a* that rotates with shaft 19 and engages a stationary component 23*b* sealed to upper adapter 15 in bore 17. Rotating seal component 23*a* is exposed to wellbore fluid and serves to reduce leakage of wellbore fluid into housing 13.

Upper adapter 15 has a well fluid passage 25 offset from central bore 17 that admits well fluid to the interior of housing 13. The inlet of well fluid passage 25 is illustrated as being on the upper end of upper adapter 15, but the inlet could alternately be on the outer diameter of upper adapter 15. Upper adapter 15 has means to secure upper seal section 11 to a component above, which in this embodiment comprises threaded bolt holes 29.

Figure 3:
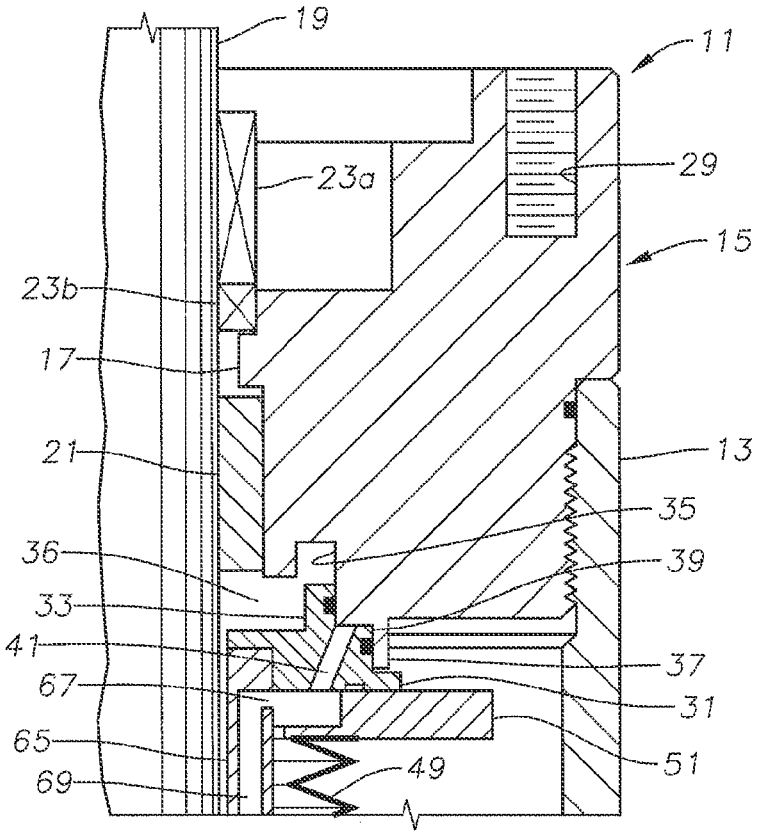
FIG. 3 is an enlarged sectional view of a portion of the seal section of FIG. 1.

A top cap 31 mounts to the lower side of upper adapter 15. The mounting arrangement can be varied. Referring to FIG. 3, in this embodiment, top cap 31 has a cylindrical neck 33 that inserts into and seals against a lower counterbore 35 of upper adapter bore 17. The sealing engagement of top cap 31 with upper adapter 15 defines an upper leakage chamber 36 on the upper side of top cap 31. Upper leakage chamber 36 receives any leakage of well fluid past upper seal 23. Top cap 31 has a central bore through which shaft 19 passes, but there is no seal in the central bore. Upper adapter 15 has a cylindrical skirt 37 extending downward from a lower side of upper adapter 15 concentric with bore 17. An outer diameter portion 39 of top cap 31 seals against the inner diameter of skirt 37. One or more lubricant ports 41 extend from a lower side of top cap 31 to an upper side at a point between neck 33 and skirt 37. Lubricant ports 41 may be inclined relative to the axis of shaft 19 as shown.

Figure 4:
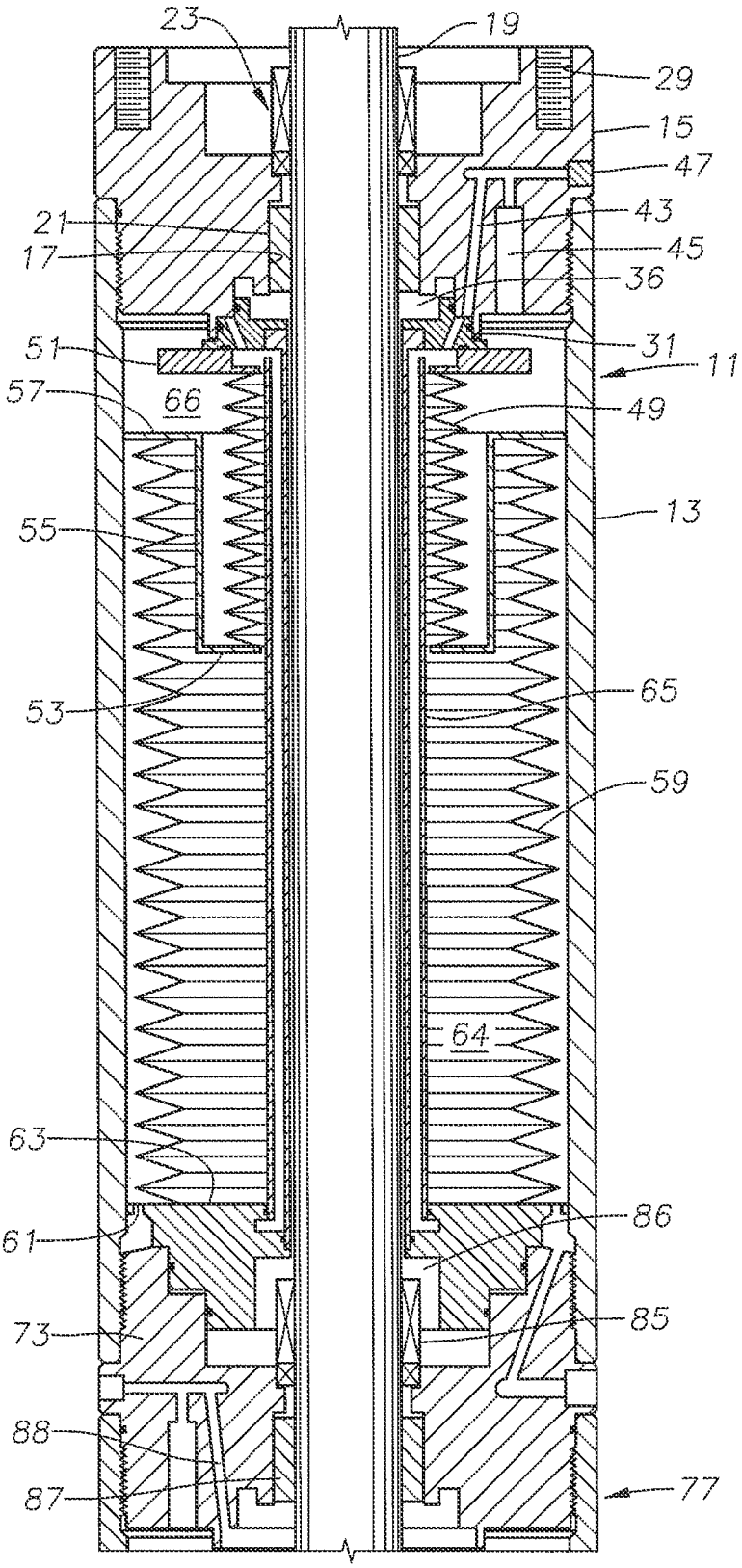
FIG. 4 is a sectional view of the seal section of FIG. 1, taken 90 degrees from the sectional view of FIG. 1.

Referring to FIG. 4, the upper ends of lubricant ports 41 communicate with an expelled lubricant passage 43 in upper adapter 15. Expelled lubricant passage 43 leads to one or more check valves 45. Check valves 45 allow expelled lubricant flowing out ports 41 to be directed back into housing 13. A plug 47 in a radial section of expelled lubricant passage 43 blocks passage 43 from wellbore fluid on the exterior of upper adapter 15.

Referring again to FIG. 1, an upper flexible member or bellows 49 has an upper end 51 secured to the lower side of top cap 31. Upper bellows 49 is a cylindrical member having folds or undulations in its sidewall to allow it to axially extend and contract. Upper bellows 49 is preferably formed of metal for use in high temperature wells. Upper bellows 49 has an upper end 51 that is secured and sealed to the lower side of top cap 31. Expelled lubricant passages 43 communicate with the interior of upper bellows 49. The lower end 53 of upper bellows 49 is secured to an internal flange at a lower end of a rigid sleeve 55. Sleeve 55 extends upward around a portion of upper bellows 49 and has upper external flange that forms an upper end 57 of a lower bellows 59.

A lower end 61 of lower bellows 59 is secured to a bottom cap 63 that is stationarily mounted in housing 13. Lower bellows 59 has a larger inner and outer diameter than upper bellows 49. Lower bellows 59 is also preferably formed of metal and has undulations or folds in its sidewall to allow axial extension and contraction. The interiors of upper and lower bellows 49, 59 are in fluid communication with each other, defining an internal lubricant chamber 64. An external or well fluid chamber 66 is defined by the space between the inner sidewall of housing 13 and the exterior sides of bellows 49, 59. When the pressure in lubricant chamber 64 exceeds the pressure in well fluid chamber 66, lower bellows 59 extends axially in length, which causes sleeve 55 to move upward, contracting the length of upper bellows 49. When the pressure in lubricant chamber 64 is less than in well fluid chamber 66, the reverse occurs.

Figure 2:
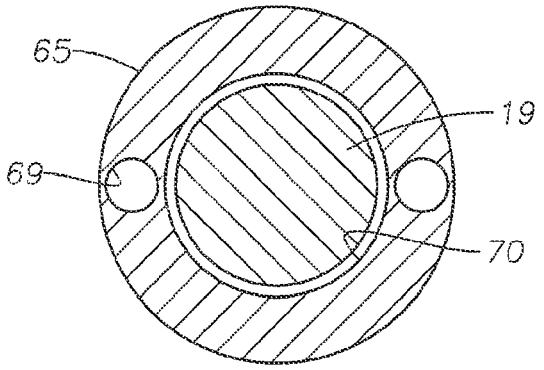
FIG. 2 is a sectional view of a portion of the seal section of FIG. 1, taken along the line 2-2.

A guide tube 65 surrounds shaft 19 and extends from bottom cap 63 to top cap 31. Guide 65 thus extends through upper and lower bellows 49, 59. The inner diameter of upper bellows 49 is only slightly greater than the outer diameter of guide tube 65 and may be in substantial contact with guide tube 65. Guide tube 65 has a plurality of upper ports 67 (FIG. 3) extending through the cylindrical sidewall of guide tube 65 near its upper end. At least one and preferably two axial guide tube passages 69 are formed in the sidewall of guide tube 65 and extend from the upper to the lower end of guide tube 65. Each guide tube passage 69 is a cylindrical bore with a diameter less than a thickness of guide tube 65 from the interior to the exterior. As shown in FIG. 2, in this example, two guide tube passages 69 are formed 180 degrees apart from each other, A small annular clearance or inner annular space 70 is located between the inner diameter of guide tube 65 and the outer diameter of shaft 19. Radial ports 67 join axial passages 69, placing axial passages 69 in fluid communication with motor lubricant in bellows internal chamber 64. Guide tube passages 69 are sealed from inner annular space 70. Lubricant chamber 69 is also sealed from inner annular space 70.

The lower end of guide tube 65 joins bottom cap 63. Lower lubricant communication passages 71 are located in bottom cap 63. Lower lubricant communication passages 71 are also sealed from inner annular space 70 and extend from the lower end of axial passages 69 downward and outward.

A central adapter 73, which may also be considered to be a lower adapter has external threads for securing to internal threads in the lower end of housing 13. Central adapter 73 has a lubricant communication port 75 with an upper end in fluid communications with the lower ends of lower lubricant communication passages 71. Communication port 75 extends to the lower side of central adapter 73. In this example, central adapter 73 also has external threads secured to internal threads of a lower seal section 77, which is only partially shown. Central adapter 73 has a first counterbore 79 at its upper end and a second counterbore 81 joining a lower edge of first counterbore 79. First counterbore 79 is larger in diameter than second counterbore 81. Bottom cap 63 has an upper outer diameter portion that sealingly engages first counterbore 79 and a lower outer diameter portion that sealingly engages second counterbore 81. Bottom cap ports 71 terminate between counterbores 79, 81, forming an annular gallery 83 that communicates with central adapter port 79.

One or more lower seals 85 are mounted in central adapter for sealing around shaft 19. Lower seal 85 may be a mechanical face seal of the same type as upper seat 23. If two lower seals 85 are used, they would be mounted back to back with the rotating components next to each other. The sealing engagement of bottom cap 63 with second counterbore 81 plus seal 85 define a chamber 86. Chamber 86 serves as a lower well fluid leakage chamber to collect any leakage of well fluid past lower seal 85. Chamber 86 is in fluid communication with inner annular space 70 between shaft 19 and guide tube 65, thus also communicates with chamber 36. A bushing 87 in central adapter 73 below seal 85 radially supports shaft 19.

Referring to FIG. 4, central adapter 73 may have expelled lubricant ports 88 that serve the same purpose in lower seal section 77 as expelled lubricant ports 43. Lower seal section 77 will have upper and lower bellows similar to bellows 49, 59. The lower end of lower lubricant communication port 75 will communicate with the exterior of the upper bellows in lower seal section 77. Lower seal section 77 may also have a guide tube similar to guide tube 65 and a top cap similar to top cop 31. In addition, lower seal section 77 will normally have a thrust bearing (not shown) for absorbing axial thrust imposed on shaft 19. Upper and lower seal sections 11, 77 will also have various ports for filling with lubricant and expelling air.

Figure 5:
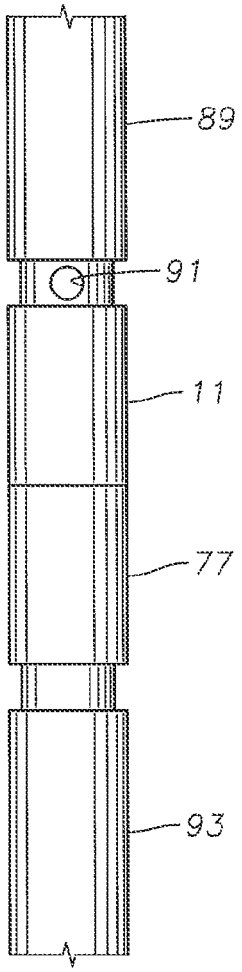
FIG. 5 is a side view of an electrical pump assembly containing the seal section of FIG. 1.

Referring to FIG. 5, a pump 89 having an intake 91 will normally be connected to upper adapter 15 (FIG. 1) of upper seal section 11. Pump 89 is typically a centrifugal pump having a plurality of stages of impellers and diffusers. A motor 93, which is normally electrical, has an upper end that connects to lower seal section 77 in this embodiment. Electrical motor 93 is filled with a dielectric lubricant that communicates with the lubricant in seal sections 11, 77.

In operation, motor 93 will be connected to seal sections 11, 77. Lubricant is introduced into the sub assembly of motor 93 and seal sections 11, 77 and air expelled or evacuated. As the assembly of FIG. 5 is lowered into a fluid-filled well, the well fluid will enter bellows external well fluid chamber 66 via well fluid passage 25. The well fluid often contains a high percentage of water, which would be highly detrimental to motor 93 if the well fluid enters motor 93. Referring to FIG. 1, the hydrostatic pressure of the well fluid in well fluid chamber 66 acts against bellows 49, 59, tending to cause lower bellows 59 to axially contract in length. Lubricant within lubricant chamber 64 tends to resist the contraction. When the pump assembly reaches a selected depth, the operator will supply power to motor 93, which rotates shaft 19 to drive pump 89. As motor 93 operates, it generates heat, which causes expansion of lubricant. Expansion of the lubricant causes lower bellows 59 to axially extend. If lower bellows 59 reaches a fully extended position, some of the lubricant will be expelled from lubricant chamber 64 through top cap ports 41 (FIG. 3) and expelled lubricant passage 43 (FIG. 4). The expelled lubricant flows through check valves 45 into external chamber 66. When motor 93 is shut dawn, the lubricant cools and lower bellows 59 will contract in length. This contraction causes upper bellows 49 to extend in length.

While operating, some leakage of well fluid past seal 23 normally occurs. The well fluid flows past bushing 21 into well fluid leakage chamber 36 (FIG. 3). Well fluid is heavier than the lubricant located in annular clearance 70 between shaft 19 and guide tube 65. Consequently, the encroaching well fluid may migrate downward in annular clearance 70 and into well fluid leakage chamber 86 (FIG. 1). However, the pump assembly may be oriented nearly horizontal, making it easier for well fluid to flow bath upward and downward within seal sections 11, 77. Some leakage of the fluid in chamber 86 occurs, resulting in the well fluid flowing past seal 85 and bushing 87 into lower seal section 77. This well fluid would enter a similar chamber in lower seal section 77 to chamber 36 above top cap 31 in upper seal section 11. Some well fluid may eventually enter bellows lubricant chamber 64 in upper seal section 11. Before any well fluid in bellows lubricant chamber 64 could enter lower seal section 77, it would have to flow along a serpentine path up the exterior of guide tube 65, through upper ports 67 (FIG. 3) in guide tube 65 and down axial guide tube passages 69. Guide tube passages 69 and the exterior of guide tube 65 are isolated from the well fluid in well fluid leakage chambers 36, 86 and from the well fluid in housing well fluid chamber 66. Normally, any well fluid in bellows lubricant chamber 64 will be located closer to bottom cap 63 than top cap 31.

Rather than two seal sections, a single seal section having a guide tube with axial passages could be employed. In that instance central adapter 73 would secure to motor 93. Also, more than two seal sections could be mounted together. In addition, rather than having separate axial passages formed in a single guide tube, two concentric guide tubes may be utilized, with the axial passage being an annular space between the guide tubes.

While the disclosure has been shown in only one of its forms, it should be apparent to those skilled, in the art that it is not so limited but is susceptible to various changes without departing from the scope of the disclosure.

The invention claimed is:

1. A submersible well pump assembly, comprising:

a rotary pump;

a motor for driving the pump;

a seal section coupled between the motor and the pump, comprising:

a cylindrical housing having a longitudinal axis, an upper adapter and a lower adapter;

a shaft extending axially through the housing, the upper adapter and the lower adapter for transmitting rotation from the motor to the pump;

a guide tube surrounding the shaft and extending between the upper and lower adapters;

a flexible member surrounding the guide tube, having an upper end sealed to the upper adapter and a lower end sealed to the lower adapter, defining a lubricant chamber between the guide tube and the flexible member and a well fluid chamber between the flexible member and the housing;

the housing having a well fluid passage for communicating well fluid to the well fluid chamber to apply a hydrostatic force to the flexible member corresponding to a hydrostatic force of the well fluid;

at least one guide tube passage extending axially within the guide tube between an interior and an exterior of the guide tube from an upper portion to a lower portion of the guide tube;

an upper portion of the guide tube passage being in fluid communication with lubricant in the lubricant chamber; and a lower lubricant communication passage in the lower adapter in fluid communication with a lower portion of the guide tube passage for communicating lubricant in the motor with the lubricant chamber via the guide tube passage, wherein any well fluid encroaching into the lubricant chamber must flow down the guide tube passage in order to reach the motor.

2. The assembly according to claim 1, wherein the lower lubricant communication passage is sealed from an inner annular space between the guide tube and the shaft.

3. The assembly according to claim 1, wherein the upper portion of the guide tube passage is sealed from an inner annular space between the shaft and the guide tube.

4. The assembly according to claim 1, wherein the guide tube passage comprises a cylindrical bore extending parallel with an axis of the guide tube and having a diameter less than a radial thickness of the guide tube from the interior to the exterior of the guide tube.

5. The assembly according to claim 1, wherein:

the flexible member comprises a bellows with a larger diameter portion and a smaller diameter portion, the smaller diameter portion extending into the larger diameter portion and having an inner side in substantial contact with the exterior of the guide tube.

6. The assembly according to claim 5, wherein the smaller diameter portion defines an upper end of the bellows.

7. The assembly according to claim 1, further comprising:

an upper seal mounted between the upper adapter and the shaft;

a top cap secured to a lower side of the upper adapter below the seal; and an upper end of the guide tube being secured sealingly to the top cap and isolating the exterior of the guide tube from an inner annular space between the guide tube and the shaft.

8. The assembly according to claim 1, further comprising:

a lower seal mounted between the lower adapter and the shaft;

a bottom cap secured sealingly to the lower adapter above the lower seal; wherein a lower end of the guide tube is secured sealingly to the bottom cap; and the lower lubricant communication passage extends through the bottom cap and into fluid communication with a lower end of the axially extending guide tube passage at a point that is sealed from an inner annular space between the guide tube and the shaft and above the lower seal.

9. The assembly according to claim 1, further comprising:

an upper seal mounted between the upper adapter and the shaft;

an upper leakage chamber below the upper seal and above the guide tube for receiving any leakage of well fluid past the upper seal;

a lower seal mounted between the lower adapter and the shaft;

a lower leakage chamber above the lower seal and below the guide tube for receiving any leakage of well fluid past the lower seal;

an inner annular space between the shaft and the guide tube between the upper and lower leakage chambers being in fluid communication with the upper and lower leakage chambers; and the guide tube passage being sealed from the inner annular space.

10. The assembly according to claim 1, wherein said at least one guide tube passages comprises at least two guide tube passages, each of the guide tube passages being a cylindrical bore spaced circumferentially apart from and parallel to the other.

11. A submersible pump assembly, comprising:

a rotary pump;

a motor for driving the pump;

a seal section coupled between the motor and the pump, comprising:

a cylindrical housing having a longitudinal axis, an upper adapter that couples to the pump and a lower adapter;

a shaft extending axially through the housing, the upper adapter and the lower adapter for transmitting rotation from the motor to the pump;

a guide tube surrounding the shaft and extending between the upper and lower adapters;

a bellows surrounding the guide tube, having an upper end sealed to the upper adapter and a lower end sealed to the lower adapter, defining a lubricant chamber between the guide tube and the bellows and a well fluid chamber between the bellows and the housing;

a well fluid passage extending through the upper adapter for communicating well fluid to the well fluid chamber to apply a hydrostatic force to the bellows corresponding to a hydrostatic force of the well fluid;

at least one guide tube passage extending axially within a side wall of the guide tube, the guide tube passage being a cylindrical bore parallel to and offset from an axis of the guide tube, the guide tube passage extending from an upper portion to a lower portion of the guide tube;

an upper lubricant communication passage communicating an upper portion of the guide tube passage with lubricant in the lubricant chamber;

a lower lubricant communication passage communicating a lower portion of the guide tube passage with lubricant in the motor. Wherein any well fluid encroaching into the lubricant chamber must flow down the guide tube passage in order to reach the motor; and an inner annular space between an interior of the guide tube and the shaft that is sealed from communication with lubricant in the lubricant chamber and sealed from communication with the guide tube passage.

12. The assembly according to claim 11, wherein the lower lubricant communication passage is sealed from the inner annular space between the guide tube and the shaft.

13. The assembly according to claim 11, further comprising:

an upper seal mounted between the upper adapter and the shaft;

a top cap secured to a lower side of the upper adapter below the seal; and an upper end of the guide tube being secured sealingly to the top cap and isolating an exterior of the guide tube from the inner annular space between the guide tube and the shaft.

14. The assembly according to claim 11, further comprising:

a lower seal mounted between the lower adapter and the shaft;

a bottom cap secured sealingly to the lower adapter above the lower seal; wherein a lower end of the guide tube is secured sealingly to the bottom cap; and the lower lubricant communication passage extends through the bottom cap and into fluid communication with a lower end of the axially extending guide tube passage at a point that is sealed from the inner annular space between the guide tube and the shaft.

15. The assembly according to claim 11, further comprising:

an upper seal mounted between the upper adapter and the shaft;

an upper leakage chamber below the upper seal and above the guide tube for receiving any leakage of well fluid past the upper seal;

a lower seal mounted between the lower adapter and the shaft;

a lower leakage chamber above the lower seal and below the guide tube for receiving any leakage of well fluid past the lower seal, and wherein the inner annular space between the shaft and the guide tube is in fluid communication with the upper and lower leakage chambers.

16. The assembly according to claim 11, further comprising an upper port in the guide tube below an upper end of the guide tube and extending laterally from guide tube passage to an exterior of the guide tube, communicating lubricant in the lubricant chamber with the guide tube passage.

17. The assembly according to claim 11, wherein said at least one guide tube passages comprises two of the guide tube passages spaced circumferentially apart from and parallel to each other.

18. A method of operating a submersible well pump assembly having a rotary pump, a motor, and a seal section coupled between the motor and the pump and having a drive shaft, the method comprising:

providing the seal section with a guide tube surrounding the shaft, defining an inner annular space, a flexible member surrounding the guide tube, defining a lubricant chamber between the guide tube and the flexible member and a well fluid chamber between the flexible member and the housing;

providing the guide tube with at least one guide tube passage extending axially from an upper portion to a lower portion of the guide tube and sealing the guide tube passage from the inner annular space;

operating the motor to rotate the shaft and drive the pump;

communicating well fluid to the well fluid chamber to apply a hydrostatic force to the flexible member corresponding to a hydrostatic force of the well fluid;

communicating lubricant from the lubricant chamber to an upper portion of the guide tube passage; and communicating lubricant in a lower portion of the guide tube passage with lubricant the motor.

19. The method according to claim 18, further comprising:

sealing upper and lower portions of the shaft with upper and lower seals;

communicating any leakage past the seals to the inner annular space between the shaft and the guide tube; and sealing the inner annular space from communication with the lubricant chamber.

20. The method according to claim 18, wherein providing the guide tube with at least one guide tube passage comprises boring a cylindrical hole from one end to another end of the guide tube, the hole having an axis that is offset and parallel to an axis of the guide tube.

* * * * *

UNITED STATES PATENT AND TRADEMARK OFFICE

CERTIFICATE OF CORRECTION

PATENT NO. : 8,932,034 B2
APPLICATION NO. : 13/536648
DATED : January 13, 2015
INVENTOR(S) : Kelsey A. McKinney et al.

It is certified that error appears in the above-identified patent and that said Letters Patent is hereby corrected as shown below:

In the Specification

Column 1, line 42, delete the "," between "life" and "of"
Column 4, line 18, insert --tube-- between "Guide" and "65"

In the Claims

Column 8, line 20, delete the "." after "motor" and insert a --,--
Column 8, line 20, delete "Wherein" and insert --wherein--

Signed and Sealed this
Twenty-third Day of June, 2015

Michelle K. Lee

Michelle K. Lee
*Director of the United States Patent and Trademark Office*